United States Patent [19]

Berkestad

[11] 4,230,177

[45] Oct. 28, 1980

[54] HEAT EXCHANGE WITH SEPARATELY SUPPORTED AND SEPARATELY REMOVABLE TUBULAR COILS

[75] Inventor: Karl-Erik Berkestad, Linköping, Sweden

[73] Assignee: Stal-Laval Apparat AB, Sweden

[21] Appl. No.: 960,242

[22] Filed: Nov. 13, 1978

[30] Foreign Application Priority Data

Nov. 16, 1977 [SE] Sweden ..... 7712575

[51] Int. Cl.[3] ..... F28F 9/00

[52] U.S. Cl. ..... 165/67; 165/76; 165/144; 165/176

[58] Field of Search ..... 165/172, 176, 173, 175, 165/144, 67, 76; 248/68 R; 70/7 A, 7 G

[56] References Cited

U.S. PATENT DOCUMENTS

| | | | |
|---|---|---|---|
| 1,788,068 | 1/1931 | Scott | 165/172 |
| 2,038,912 | 4/1936 | Summers | 165/172 |
| 2,068,955 | 1/1937 | Kritzer et al. | 165/172 |
| 2,118,206 | 5/1938 | Kritzer et al. | 165/172 |
| 2,301,433 | 11/1942 | McElgin | 165/176 |
| 2,347,957 | 5/1944 | McCullough | 165/172 |
| 2,567,716 | 9/1951 | Kritzer | 165/162 |
| 2,834,583 | 5/1958 | Oldberg et al. | 165/67 |
| 3,153,443 | 10/1964 | Kritzer | 165/67 |

FOREIGN PATENT DOCUMENTS

| | | | |
|---|---|---|---|
| 182809 | 3/1963 | Sweden | 165/176 |
| 197187 | 5/1923 | United Kingdom | 165/172 |

*Primary Examiner*—Sheldon Richter

*Attorney, Agent, or Firm*—Watson, Cole, Grindle & Watson

[57] ABSTRACT

The spaced apart elongated supporting members for the various tubular coils of a heat exchanger include vertically spaced apart openings in a wall portion thereof which faces an associated supporting member, the tubular coil being fitted to extend through the openings and thus be supported by the supporting members. A pair of such members, together with the supported tubular coil, comprise a heat exchange section, the entire heat exchanger including a multiplicity of such sections. Each individual section can be separately disconnected and removed from the heat exchanger if a leak develops in the supported tubular coil in a fast and efficient manner.

15 Claims, 6 Drawing Figures

HEAT EXCHANGE WITH SEPARATELY SUPPORTED AND SEPARATELY REMOVABLE TUBULAR COILS

BACKGROUND OF THE INVENTION

1. Field of the Invention

The present invention relates to heat exchangers of the type which are positionable so as to be in a heat exchange relationship with a flowing gaseous medium, and which include tubular coils positioned between spaced apart supporting walls.

2. Description of the Prior Art

Conventional heat exchangers of the type which are positionable in the flow of a working medium generally utilize as supporting walls for the tubular coils therein which carry the liquid medium to be heated or cooled, two spaced apart supporting plates which are provided with a number of holes through which the tubular coils are extended. To enable mounting, the tubular coils must be divided up so that they can be fitted through the holes in the plates, and thereafter they are joined together, e.g., by welding. The welding work is expensive and requires careful and cost-demanding control so that the tubular strength requirements are met, e.g., because the tubes are often heavily loaded by the working medium.

Another conventional type of heat exchanger utilizes as tube supporting means a multiplicity of rods which are attached together at their upper ends and which are provided at their lower ends with suspension devices to which the tubular coils can be mounted. However, with this system when the external working medium flows in a vertical direction, the suspension devices and the collecting vessels will be positioned in the flow path which will in fact disturb it, and, furthermore, if the medium flow comprises a very hot gas and flows from top to bottom through the exchanger, the suspension devices will also become very hot. In these situations a separate cooling medium such as water will be required to cool the suspension devices (so that they can maintain their strength properties), and such a set up complicates the entire heat exchanger construction. Heat exchangers of this type normally are used to heat up and evaporate water which is flowing through the tubular coils by means of a hot gas.

It is thus an object of the present invention to provide an improved heat exchanger in which the tubular coils are supported in a fashion which avoids the disadvantages of the prior art supporting structures.

SUMMARY OF THE INVENTION

According to the present invention, the heat exchanger is composed of a multiplicity of separate sections which are fixedly securable in side-by-side relationship to form the heat exchanger, each separate section comprising two spaced apart elongated supporting members which support therebetween a separate tubular coil. Each of the two sets of spaced apart supporting members form an opposite wall of the heat exchanger. Each particular section of the heat exchanger can be removed from the heat exchanger, e.g., if a leak develops in the supported tubular coil, by detaching the connections of the particular tubular coil to either then adjacent tubular coil or to adjacent collecting vessels and then detaching the members which fixedly secure the supporting members of each of the exchanger walls together.

According to the present invention, no welding work or the like has to be carried out on the spot; instead, a defective tubular section can be quite easily removed and replaced by another and the defective section can be repaired somewhere else, i.e., where repair work is more suitable.

Furthermore, according to one embodiment of the invention, instead of removing a whole section of the heat exchanger when a tubular coil thereof develops a leak, only a portion thereof can be removed, i.e., the tubular coil and only one of the supporting members, due to the structural supporting arrangement for the tubular coil. Indeed, in another embodiment of the invention a tubular coil can be removed from the heat exchanger without concurrently removing either of the supporting members.

Further objects, advantages and features of the invention will be apparent from the arrangement and construction of the constituent parts in detail as set forth in the following description taken together with the accompanying drawings.

DETAILED DESCRIPTION OF THE PREFERRED EMBODIMENTS

Figure 1:
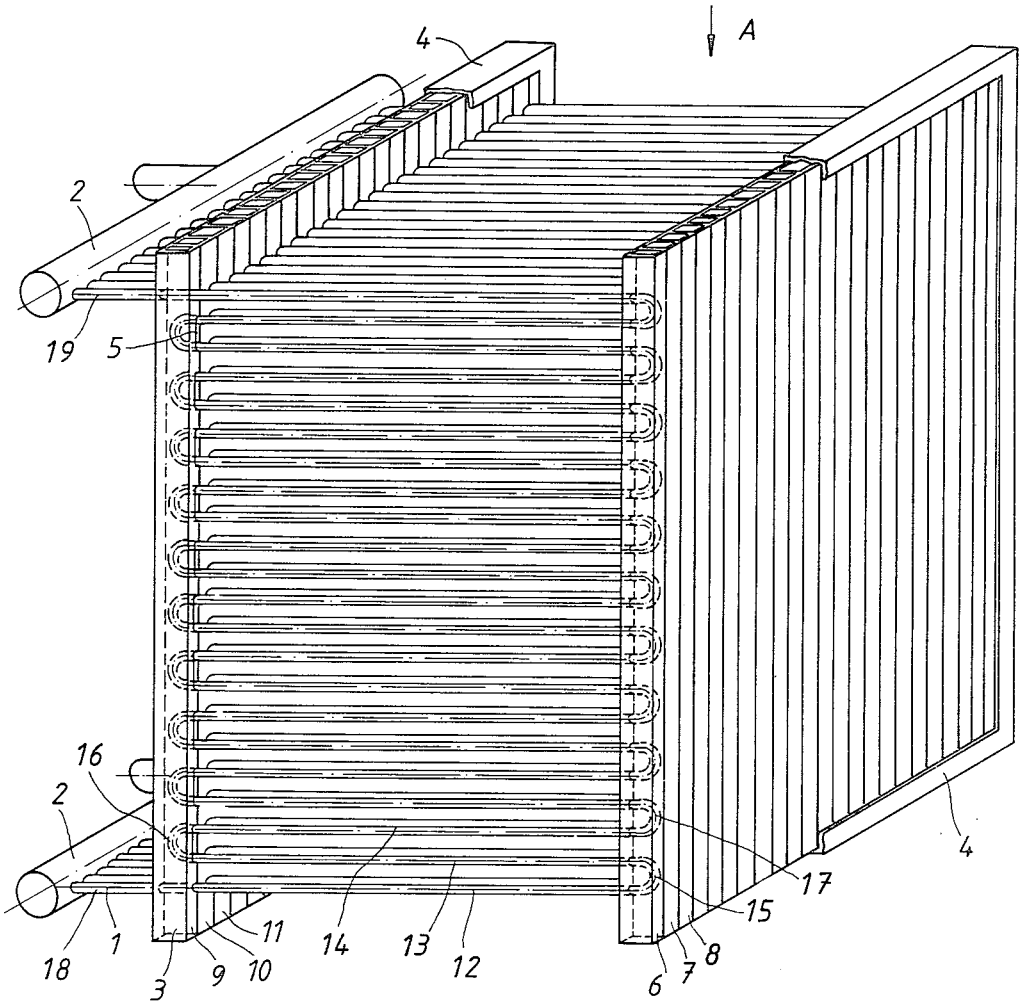
FIG. 1 depicts a perspective view of a heat exchanger, partially cut away, in accordance with the present invention.

FIG. 1 shows a heat exchanger in accordance with the present invention, with the flowing medium A being shown as moving vertically downwardly through the tubular coils. The heat exchanger is composed of a number of individual side-by-side sections, each section comprising spaced apart supporting members which support an associated tubular coil. Thus, one section (labeled as 3) includes opposed supporting members 9, 6 which support a tubular coil 1, a second section includes opposed supporting members 10, 7 which support another tubular coil (unlabeled), a third segment includes opposed supporting members 11, 8 which support another tubular coil (unlabeled), etc. The various sections of the heat exchanger are fixedly positionable in side-by-side relationship by means of frame members 4, each frame member being capable of enclosing the opposed walls of the heat exchanger formed by the adjacent combination of supporting members. Each of the tubular coils supported by the opposed supporting members is formed to have a number of vertically spaced apart horizontal segments (such as 12, 13, 14, etc.) and bent segments (such as 15, 16, 17, etc.) which appropriately interconnect the horizontal segments. The opposite ends of each tubular coil may be separately connected to collecting vessels 2 by connecting tubes 18, 19 or else the various tubular coils may be connected in series throughout the whole, or throughout portions, of the heat exchanger.

The spaced apart supporting members of each heat exchange section are capable of supporting the associated tubular coil at a number of locations. As can be seen from FIG. 1, the wall portion of supporting member 9 which faces supporting member 6 is formed so as to have a number of vertically spaced apart elongated slots, whereas the wall portion of supporting member 6 which faces supporting member 9 is formed so as to have a number of vertically spaced apart holes. The elongated slots of one supporting member and the holes of the other supporting member are of such dimensions and positioning that with respect to the former, two adjacent horizontal segments (with interconnecting bent section) of tubular coil will be jointly positionable within and will be supportable by the supporting member 9, and with respect to the latter, two adjacent horizontal segments will be separately positionable within a hole and thus supportable by the supporting member 6.

Figure 2:
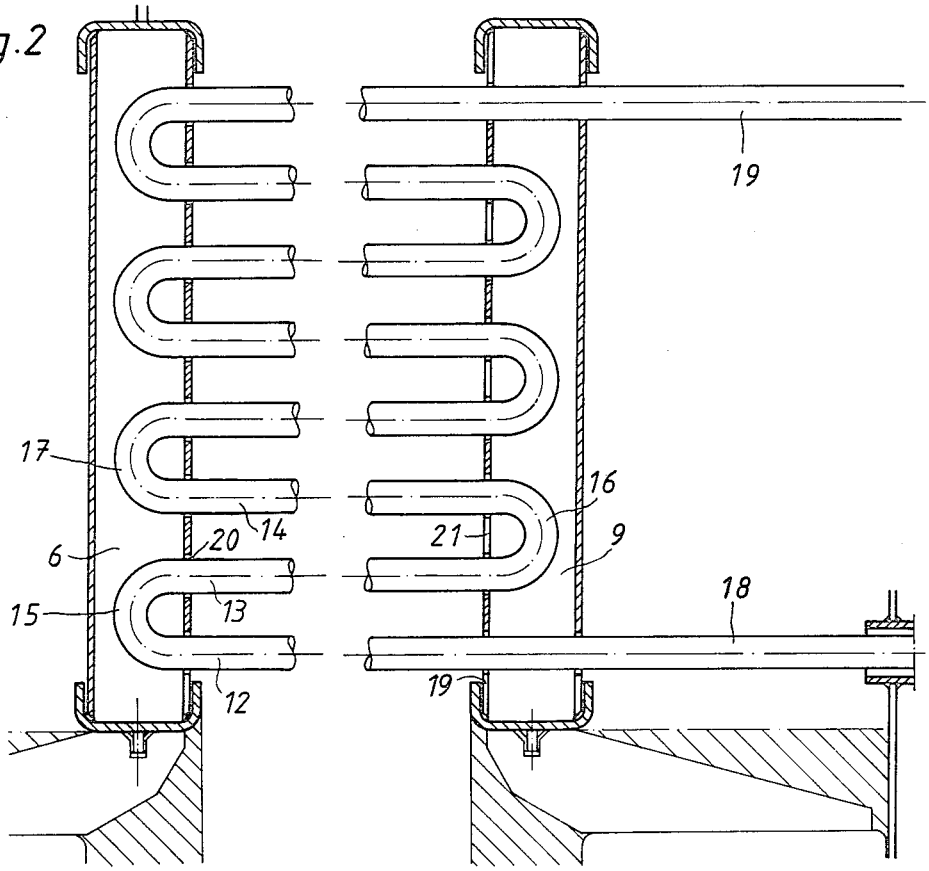
FIG. 2 shows a side cross-sectional view of the construction of one of the sections of the inventive heat exchanger, and FIGS. *3a–d* show enlarged cross sectional top views of various alternative profile shapes of section supporting members in side-by-side relationship.

FIG. 2 shows in more detail the supporting relationship between the facing walls of the spaced apart supporting members 6, 9 and the tubular coil (the orientation being reversed from that shown in FIG. 1). The left-hand portion of the horizontal tubular segment 12 extends through a circular hole (unlabeled) in the wall portion of member 6 which faces member 9, and the left-hand portion of the horizontal tubular segment 13 also extends through a different circular hole 20, the two segments being interconnected by a bent segment 15 which is positioned within the supporting member 6 (which in this case is a hollow, elongated member having a rectangular cross-section). The right-hand portion of horizontal tubular segment 13 passes through an elongated slot 21 in the wall portion of member 9 which faces member 6, and the right-hand portion of the next higher horizontal tubular segment 14 also passes through the same slot 18. The interconnecting bent segment 16 is positioned within the hollow, elongated member 9 which has a rectangular cross-section. The same structural features and interactions prevail along the entire elongated length of the members 9 and 6.

Due to the use of the slots in supporting member 9, if the tubular coil develops a leak, the connecting tubes 18, 19 can be cut, the left-hand frame 4 can be detached or appropriately cut up, and the supporting member 6, together with the tubular coil 1, removed from within the heat exchanger, e.g., by movement of these interconnected structures to the left in FIG. 2 and away from supporting member 9.

Figure 3A:
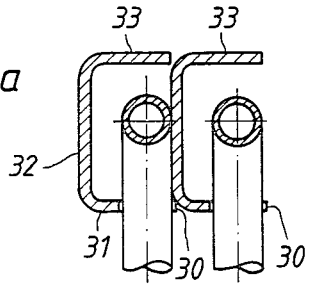
Figure 3B:
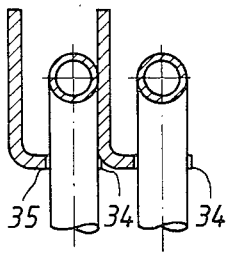
Figure 3C:
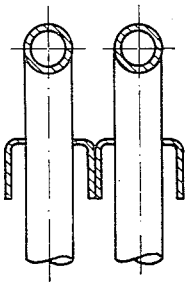
Figure 3D:
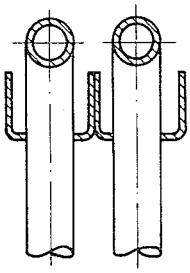

As shown in FIGS. 3*a–d* the elongated supporting members for the tubular coils need not be rectangular in horizontal cross-section, but may take a variety of different shapes. For example, they may be block C-shaped as shown in FIG. 3*a*, they may be L-shaped as shown in FIG. 3*b*, they may be block n-shaped as shown in FIG. 3*c*, or they may be block U-shaped as shown in FIG. 3*d*. In each instance the members may be easily placed in side-by-side relationship with one another and they will have a wall portion available for facing the other member of the heat exchange section. When the supporting members are shaped as shown in FIGS. 3*a* and 3*b*, the openings in the facing walls for support of the tubular coil may be positioned adjacent one of the free sides thereof so as to have an unenclosed portion, i.e., with respect to the bars of FIG. 3*a* which have block C-shaped, horizontal cross sections, the openings are located adjacent the side edge 30 of extension wall 31 (the bar having a center wall 32 and two extension walls 31, 33) so as to have an unenclosed portion, and with respect to the bars of FIG. 3*b* which have L-shaped horizontal cross sections, the openings are located adjacent the side edge 34 of wall 35 so as to have an unenclosed portion. With these embodiments it is possible to remove one of the supported tubular coils from the heat exchanger without the need to permanently remove either of the spaced apart supporting members, i.e., by simply sliding the tubular coil sideways out of the openings in the bars once the section has been removed from the exchanger. When the supporting members are shaped as shown in FIGS. 3*c* and 3*d*, the tubular coil simply extends through the facing wall portion of the supporting member and does not therefore have bent segments enclosed in a hollow area (as in the embodiment of FIG. 2).

It should be recognized that it is not absolutely necessary according to the invention that one of the supporting members of a heat exchanger section include vertically spaced apart holes and the other supporting member include vertically spaced apart slots: both supporting members may include vertically spaced apart slots, or both may include vertically spaced apart holes. In this latter case, when a section of the heat exchanger is to be replaced, both supporting members (together with supported tubular coil) must be permanently removed from the frames 4.

Furthermore, it is not absolutely necessary that the heat exchange sections be held together with frames 4: other means for this purpose can just as well be employed. For example, pull rods (not shown) could be utilized, or else the desired result could even be obtained by a suitable construction of the gas channel.

According to the invention, when the flow of fluid medium moves from top to bottom (as in FIG. 1) and for example consists of a gas which is so hot that the temperature would detrimentally affect the strength of the material of the supporting member, the inventive arrangement provides the advantage that the greatest load weight of the tubular coil will be the least at the upper portions of the supporting members (where they will be the hottest), and the most at the lower portions (where they will be the coolest due to the heat reduction in the gas as it passes through the heat exchanger). This advantage is of course in addition to the advantage of being able to replace any of the tubular coils independently of the next one, i.e., if a leak therein should develop after long use.

The heat exchanger shown in FIG. 1 may in fact be only a module within a large heat exchanger, the heat exchanger comprising a number of separate units as shown.

While there has been shown and described what is considered to be some of the preferred embodiments of the present invention, it will be obvious to those skilled in the art that various changes and modifications may be made therein without departing from the invention as defined in the appended claims.

I claim:

1. A component heat exchanger which can be easily disassembled and reassembled to replace defective portions thereof, said heat exchanger comprising a multiplicity of individual sections positioned in side-by-side relationship, each individual section including two spaced apart elongated supporting members and a tubular coil supported therebetween, the side-by-side positioned individual sections thus forming two spaced apart sets of side-by-side positioned elongated supporting members, each said elongated supporting member including a wall facing the corresponding supporting member of the individual section, said facing wall of each supporting member including spaced apart openings positioned in the longitudinal direction thereof, said tubular coil comprising a multiplicity of vertical spaced apart horizontal segments and interconnecting bent segments, said horizontal segments being positioned to extend through said openings in said facing walls of said supporting members so as to be supported by said supporting members, and wherein said individual sections are fixedly positioned in side-by-side relationship by separate clamping means which separately clamp together the elongated supporting members which form said two sets of elongated supporting members.

2. The heat exchanger of claim 1 wherein each said supporting member comprises an elongated hollow beam having a rectangular cross-section.

3. The heat exchanger of claim 1 wherein each said supporting member comprises an elongated bar having a block C-shaped cross section as seen from the other supporting member of the respective individual section.

4. The heat exchanger of claim 1 wherein each said supporting member comprises an elongated bar having an L-shaped horizontal cross section as seen from the other supporting member of the respective individual section.

5. The heat exchanger of claim 1 wherein each said supporting member comprises an elongated bar having a block n-shaped horizontal cross section as seen from the other supporting member of the respective individual section.

6. The heat exchanger of claim 1 wherein each said supporting member comprises an elongated bar having a block U-shaped horizontal cross section as seen from the other supporting member of the respective individual section.

7. The heat exchanger of claim 1 wherein each of said clamping means comprises a frame which encases the ends of all the elongated supporting members which it clamps together.

8. The heat exchanger of claim 1 wherein each tubular coil of each individual section includes connecting tubes attached to the ends thereof for connection with separate collector vessels.

9. The heat exchanger of claim 1 wherein each tubular coil of each individual section is connected in series with at least one tubular coil of an adjacent individual section.

10. The heat exchanger of claim 1 wherein the openings in the facing wall of at least one supporting member of each individual section are slot shaped.

11. The heat exchanger of claim 1 wherein the openings in the facing wall of one supporting member of each individual section are shaped as circular holes.

12. The heat exchanger of claim 1 wherein each said supporting member comprises an elongated bar having a block C-shaped horizontal cross section as seen from the other supporting member of the respective individual section so as to have a center wall and two spaced apart extension walls with free edges, and wherein said openings in the facing walls are located within either one of the extension walls and adjacent a free edge so as to have an unenclosed portion.

13. The heat exchanger of claim 1 wherein each said supporting member comprises an elongated bar having an L-shaped horizontal cross section as seen from the other supporting member of the respective individual section, with each of the two connected walls having free edges, and wherein said openings in the facing walls are located adjacent a free edge of either one of said walls so as to have an unenclosed portion.

14. The heat exchanger of claim 1 wherein the openings in the facing wall of a first supporting member of each individual section are slot shaped, wherein the openings in the facing wall of the second supporting member of each individual section are in the form of circular holes, wherein two adjacent spaced apart horizontal segments of the tubular coil have and non-interconnected ends which fit within separate circular holes in said second supporting member so as to be supported by said second supporting member, and wherein the opposite and interconnected ends of said two adjacent spaced apart horizontal segments of the tubular coil fit within a single slot in said first supporting member, such that the horizontal segments of said tubular coil can be slidingly removed from within the slots of said first supporting member.

15. A heat exchanger which can be easily disassembled and reassembled to replace defective parts, said heat exchanger comprising a multiplicity of individual sections positioned in side-by-side relationship, each individual section including two spaced apart elongated supporting members and a tubular coil supported therebetween, the side-by-side positioned individual sections thus forming two spaced apart sets of side-by-side positioned elongated supporting members, each said elongated supporting member including a wall facing the corresponding supporting members of the individual section, said facing wall of each supporting member including spaced apart openings positioned in the longitudinal direction thereof, said tubular coil comprising a multiplicity of vertical spaced apart horizontal segments and interconnecting bent segments, said horizontal segments being positioned to extend through said openings in said facing walls of said supporting members so as to be supported by said supporting members, each said elongated supporting member also including a wall opposite said facing wall which is flat, such that the two sets of side-by-side positioned elongated members define smooth outer walls for the heat exchanger.

* * * * *